US009690250B2

(12) United States Patent
Saito et al.

(10) Patent No.: US 9,690,250 B2
(45) Date of Patent: Jun. 27, 2017

(54) IMAGE FORMING APPARATUS

(71) Applicants: Tomohiko Saito, Ibaraki (JP); Toshiya Satoh, Kanagawa (JP); Norio Kudoh, Kanagawa (JP); Hiroyuki Uenishi, Kanagawa (JP); Daisuke Tomita, Kanagawa (JP)

(72) Inventors: Tomohiko Saito, Ibaraki (JP); Toshiya Satoh, Kanagawa (JP); Norio Kudoh, Kanagawa (JP); Hiroyuki Uenishi, Kanagawa (JP); Daisuke Tomita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/016,129

(22) Filed: Feb. 4, 2016

(65) Prior Publication Data

US 2016/0231704 A1 Aug. 11, 2016

(30) Foreign Application Priority Data

Feb. 5, 2015 (JP) ..... 2015-020839

(51) Int. Cl.

| | |
|---|---|
| ***G03G 21/00*** | (2006.01) |
| ***G03G 21/20*** | (2006.01) |
| ***G03G 15/00*** | (2006.01) |

(52) U.S. Cl.

CPC ..... *G03G 21/0094* (2013.01); *G03G 15/5008* (2013.01); *G03G 21/203* (2013.01)

(58) Field of Classification Search

CPC ..... G03G 15/0291; G03G 15/5008; G03G 21/0094

USPC ..... 399/43

See application file for complete search history.

(56) References Cited

U.S. PATENT DOCUMENTS

2007/0292178 A1* 12/2007 Iwasaki ..... G03G 21/0058 399/357
2009/0257778 A1* 10/2009 Isobe ..... G03G 15/50 399/167
2010/0239276 A1* 9/2010 Nagatsuka ..... G03G 15/757 399/43

(Continued)

FOREIGN PATENT DOCUMENTS

JP 2002-082573 3/2002
JP 2002-123144 4/2002

(Continued)

*Primary Examiner* — David M Gray
*Assistant Examiner* — Andrew V Do
(74) *Attorney, Agent, or Firm* — Duft, Bornsen & Fettig, LLP

(57) ABSTRACT

An image forming apparatus includes an image bearer; a charger to charge a surface of the image bearer; an exposure device to expose the surface of the image bearer and form an electrostatic latent image on the image bearer; a developing device to adhere electrically charged toner to the electrostatic latent image on the image bearer, to thereby form a toner image; a microprocessor to control rotation of the image bearer; and a sensor to detect temperature and humidity. In a state of suspended rotation of the image bearer, the microprocessor controls the image bearer to rotate a predetermined amount at a predetermined interval and determines whether a rotation operation of the image bearer is to be performed, based on a detection result of the sensor.

7 Claims, 4 Drawing Sheets

(56) References Cited

U.S. PATENT DOCUMENTS

| | | | | |
|---|---|---|---|---|
| 2011/0008064 | A1* | 1/2011 | Naito | G03G 15/5008 399/44 |
| 2012/0328332 | A1 | 12/2012 | Kosuge et al. | |
| 2013/0243486 | A1 | 9/2013 | Satoh | |
| 2013/0344422 | A1* | 12/2013 | Iwanaga | G03G 5/14708 430/56 |
| 2014/0270847 | A1 | 9/2014 | Uenishi et al. | |

FOREIGN PATENT DOCUMENTS

| | | | |
|---|---|---|---|
| JP | 2010-217712 | | 9/2010 |
| JP | 2010217712 | A * | 9/2010 |
| JP | 2010-244030 | | 10/2010 |

* cited by examiner

IMAGE FORMING APPARATUS

CROSS-REFERENCE TO RELATED APPLICATION

The present application claims priority pursuant to 35 U.S.C. §119(a) from Japanese patent application number 2015-020839, filed on Feb. 5, 2015, the entire disclosure of which is incorporated by reference herein.

BACKGROUND

Technical Field

The present invention relates to an image forming apparatus such as a copier, a printer, or a facsimile machine.

Related Art

In an image forming apparatus employing the electrophotographic method, a surface of a photoconductor image bearer is charged by a charging device or a charger, typically by corona discharge.

Processes performed in the image forming apparatus employing the electrophotographic method include, for example, (1) charging the surface of the photoconductor by a charging member such as a charger or a charging roller; (2) forming an electrostatic latent image on the surface of the photoconductor with an LD or LED, and discharging the surface of the photoconductor; (3) developing the latent image on the discharged portion on the photoconductor with toner by a developing device to render the latent image visible; (4) transfer the written toner image onto a transfer member such as an intermediate transfer belt or a sheet of paper; and (5) fixing the toner image onto the sheet of paper by a fixing device.

In the above transfer process (4), residual toner remaining on the photoconductor not transferred from the photoconductor to the transfer member is collected by a cleaner, so that the residual toner does not adversely affect subsequent image forming processes.

SUMMARY

In one embodiment of the disclosure, provided is an optimal image forming apparatus that includes an image bearer; a charger to charge a surface of the image bearer; an exposure device to expose the surface of the image bearer and form an electrostatic latent image on the image bearer; a developing device to adhere electrically charged toner to the electrostatic latent image on the image bearer, to thereby form a toner image; a microprocessor to control rotation of the image bearer; and a sensor to detect temperature and humidity. In a state of suspended rotation of the image bearer, the microprocessor controls the image bearer to rotate a predetermined amount at a predetermined interval and determines whether a rotation operation of the image bearer is to be performed, based on a detection result of the sensor.

In another embodiment of the disclosure, provided is an optimal image forming apparatus that includes an image bearer; a charger to charge a surface of the image bearer; an exposure device to expose the surface of the image bearer and form an electrostatic latent image on the image bearer; a microprocessor to control rotation of the image bearer; and a developing device to adhere electrically charged toner on the electrostatic latent image on the image bearer, to thereby form a toner image. In a state of suspended rotation of the image bearer, the microprocessor the image bearer to rotate a predetermined amount at a predetermined interval, and determines whether a rotation operation of the image bearer is to be performed, based on a use history of the image bearer. In further another embodiment of the disclosure, provided is an optimal image forming apparatus that includes an image bearer; a corona charger to charge a surface of the image bear by corona charging; an image bearer cleaner to remove a residual toner remaining on the surface of the image bearer; a lubricant applicator to coat a lubricant on the image bearer; a mode to remove the corona products accumulated on the surface of the image bearer; and a microprocessor to slightly rotate the image bearer in a standby time of the image forming apparatus. The microprocessor changes a time to perform a slight rotation of the image bearer based on a number of prints from when a previous corona products removal mode has been performed to when a next corona products removal mode is performed.

These and other objects, features, and advantages of the present invention will become apparent upon consideration of the following description of the preferred embodiments of the present invention when taken in conjunction with the accompanying drawings.

DETAILED DESCRIPTION

In a charging process to charge a surface of the photoconductor by a charging member such as a charger or a charging roller, when the photoconductor is used in a high humidity environment, corona products generated from the charger adhere to the photoconductor as an image bearer, resulting in an abnormal image that is blurred or has white spots.

To eliminate such corona products, a pressing member such as a cleaning blade or corona products removing roller is used, or a method of providing toner between the cleaning blade and the image bearer to thereby cause the surface of the image bearer to be abraded is employed.

Figure 3:
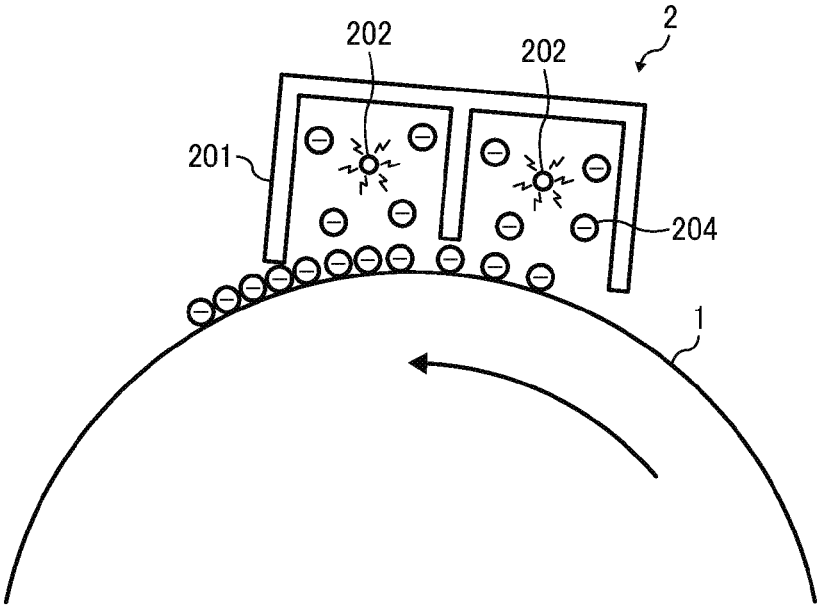
FIG. 3 illustrates the operating principle of a corona charger.

FIG. 3 schematically illustrates the operating principle of a corona charger 2 of the present embodiment.

As illustrated in FIG. 3, the corona charger 2 includes a casing 201 and a wire 202 formed mainly of tungsten coated with gold plating. A high voltage of several kilovolts is applied thereto, so that corona charging occurs and elements in the air are ionized, causing ions 204 to adhere to the surface of the photoconductor 1 and thus charging the photoconductor 1.

In this case, corona products, such as ozone, nitrogen oxide, and nitric acid, adhered to and accumulated on the corona charger 2, may adhere to the surface of the photoconductor 1 disposed immediately below the corona charger 2 after a print job is finished. Then, due to water absorbability, moisture in the air condenses, lowering the electrical resistance of the surface of the photoconductor 1. When the latent image is formed on the surface of the photoconductor 1 in this state, charged potential flows, thereby causing an abnormal image that is blurred or in which white spots appear. In addition, the corona products penetrate into the surface layer of the photoconductor 1. As a result, electrostatic capacity increases, and the potential of the photoconductor where the electrostatic capacity increased now decreases. Thus, the density of the formed image becomes thick in the electrostatic-capacity-increased portion, and a black-band-like image is generated. Such an abnormal image is not generated when a new charger is used, but is generated with a charger that has been used for a long time, thereby shortening the life of the corona charger 2.

If the photoconductor continues to rotate at a predetermined interval, the corona products such as ozone, nitrogen oxide, nitric acid, and the like can be prevented from adhering to the photoconductor.

For example, it is possible to intermittently drive the photoconductor depending on a suspended state of the photoconductor. Specifically, an image forming apparatus may be configured so that it includes a photoconductor that drives and rotates, a charger to charge a surface of the photoconductor, an exposure device to expose the charged surface of the photoconductor to form an electrostatic latent image, a developing device to form a toner image by adhering electrically charged toner onto the electrostatic latent image formed on the photoconductor, and an observation device to sequentially update a count value according to rotating and suspended state of the photoconductor, an intermittent driver to drive the photoconductor intermittently responsive to the count value updated by the observation device after the photoconductor terminates image forming operation of the toner image. The image forming apparatus further includes a sensor 55 to detect temperature and humidity, and is caused to be driven intermittently when the sensor 55 detects a temperature change.

Thus, density fluctuation of the image that tends to occur at the start of image formation can be prevented.

However, when the corona products such as nitrogen oxide adhere to the surface of the photoconductor when suspended after the print end, under conditions of high temperature and high humidity, moisture in the air condenses due to water absorbability, and the surface of the photoconductor 1 becomes low resistant. In this case, when the latent image is formed on the surface of the photoconductor, charged potential flows, thereby generating an abnormal image that is blurred or in which white spots appear.

In addition, a phenomenon in which the corona products accumulate on the surface of the photoconductor, thereby causing the abnormal image, frequently occurs when the photoconductor is left untouched for a relatively long time such as over six hours. In addition, the photoconductor which is frequently used by the user every day, is shown to generate an abnormal image such as white dots due to a very short time, even five minutes of non-operational time.

It is possible to control the image bearer to rotate slightly during standby time to prevent corona products accumulation. However, it is impossible to prevent corona products from accumulating on the image bearer depending on the frequency of printing by the user.

Considering the above problem, the present invention provides an optimal image forming apparatus that can prevent abnormal images from occurring and forms a high quality image.

Hereinafter, preferred embodiments of the present invention will be described referring to accompanying drawings.

First, a structure and operation of a printer as an image forming apparatus employing a tandem-type intermediate transfer method will be described as one example of an image forming apparatus to which the present invention is applied.

First Embodiment

Figure 1:
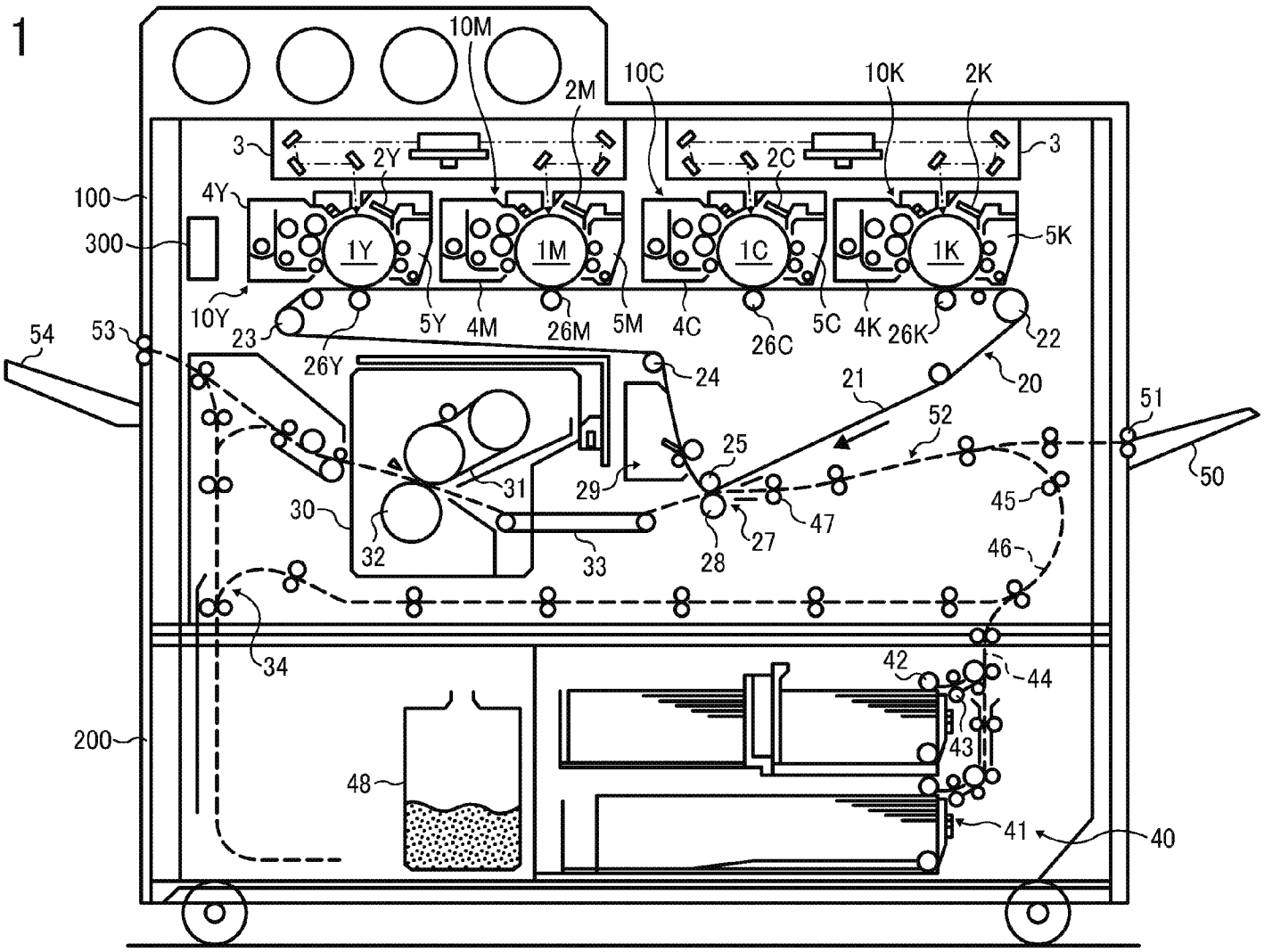
FIG. 1 schematically illustrates a structure of an image forming apparatus including image forming units, to which the present invention is applied.

FIG. 1 illustrates a structure of the image forming apparatus described above. As illustrated in FIG. 1, the present printer includes an image forming section 100 to form an image on a transfer sheet P serving as a recording medium, and a sheet feed section 200 to supply the transfer sheet P to the image forming section 100. The image forming section 100 includes four image forming units 10Y, 10M, 10C, and 10K to form a toner image of respective colors of yellow (Y), magenta (M), cyan (C), and black (K). Hereinafter, affixes of Y, M, C, and K represent each color of yellow, magenta, cyan, and black. Each image forming unit 10Y, 10M, 10C, or 10K includes each photoconductor 1C, 1M, 1Y, or 1K, respectively, that carries a toner image of each color. Around each photoconductor 1, each corona charger 2Y, 2M, 2C, or 2K to uniformly charge a surface of each photoconductor 1, and a developing device 4Y, 4M, 4C, or 4K to develop the electrostatic latent image formed on the surface of each photoconductor 1, are disposed. In addition, around each photoconductor 1, each photoconductor cleaner 5Y, 5M, 5C, or 5K to clean the surface of the photoconductor 1 after transferring the toner image, and a lubricant applicator 6 to coat the lubricant on the surface of each photoconductor 1, are disposed.

Above the image forming units 10Y, 10M, 10C, and 10K, disposed is an optical writing unit 3 to irradiate the uniformly charged surface of each photoconductor 1M, 1C, 1Y, or 1K with laser beams corresponding to image data, to thereby form an electrostatic latent image thereon. The optical writing unit 3 includes a laser light source, a polygon mirror, f-O lens, and a reflection mirror, and irradiates laser beams, while scanning in a main scanning direction, on the surface of the photoconductor 1Y, 1C, 1Y, or 1K which is driven to rotate based on each image data at a predetermined exposure position.

Below the image forming units 10Y, 10M, 10C, and 10K, disposed is a transfer unit 20 to transfer a toner image formed on each of the photoconductors 1Y, 1M, 1C, and 1K via an intermediate transfer belt 21 serving as an intermediate transfer member, to the transfer sheet P. In the transfer unit 20, an endless-belt shaped the transfer belt 21 is wound around a plurality of support rollers 23, 24, and 25 including a drive roller 22, and is driven to rotate in the counterclockwise direction. Primary transfer rollers 26Y, 26M, 26C, and 26K disposed on an interior surface of the transfer belt 21 each apply transfer electrical potential at a primary transfer position, to thereby transfer the toner image on each of the photoconductors 1Y, 1M, 1C, and 1K to the intermediate transfer belt 21. In addition, the transfer unit 20 includes a secondary transfer device 27 disposed opposite the image forming unit 10 with the intermediate transfer belt 21 sandwiched in between. The secondary transfer device 27 presses a secondary transfer roller 28 against a secondary transfer opposite roller 25 via the intermediate transfer belt 21 so that the toner image formed on the intermediate transfer belt 21 is transferred to the transfer sheet P. In addition, a belt cleaner 29 to remove residual toner remaining on the intermediate transfer belt 21 after toner image transfer to the transfer sheet P, is disposed between the support roller 24 and the secondary transfer opposite roller 25.

A fixing device 30 to fix a toner image transferred on the transfer sheet P is disposed on the left of the transfer unit 20 in FIG. 1. The fixing device 30 is configured to press the fixing belt 3 against a pressure roller 32, to thereby fix the toner image on the transfer sheet P with heat and pressure. In addition, a conveyance belt 33 to convey the transfer sheet P to the fixing device 30 is disposed between the secondary transfer device 27 and the fixing device 30. Below the transfer unit 20, a sheet reversing device 34 to reverse the transfer sheet P to record both sides of the transfer sheet P is disposed in parallel to the image forming units 10Y, 10M, 10C, and 10K.

The sheet feed section 200 includes a plurality of paper trays 41 in a paper bank 40, each paper tray to contain a bundle of the plurality of transfer sheets P stacked therein, and a pair of sheet feed roller 42 is press-contacted to a topmost transfer sheet P in each of the paper trays 41. When the selected sheet feed roller 42 rotates in this state, the topmost recording sheet P is separated by a separation roller 43 and is sent to a sheet feed path 44. The transfer sheet P sent to the sheet feed path 44 is introduced to a sheet feed path 46 inside the image forming section 100 via a plurality of sheet feed roller pairs 45, and is sandwiched between rollers of a registration roller pair 47. The registration roller pair 47 once stops rotation of the two rollers upon the transfer sheet P is sandwiched between two rollers, resumes rotation at a predetermined timing, and sends the transfer sheet P toward the secondary transfer device 27.

In the thus configured printer, image formation is performed as follows.

For example, as to the image forming unit 10Y for yellow color, a surface of the photoconductor 1Y uniformly charged by the corona charger 2Y is scanned and exposed by laser beams modified and deflected by the optical writing unit 3, and an electrostatic latent image is formed on the surface thereof. The electrostatic latent image is rendered visible by the developing device 4Y as a yellow toner image. The toner image on the photoconductor 1Y is transferred to the intermediate transfer belt 21 at a primary transfer position opposite the primary transfer roller 26 with the intermediate transfer belt 21 sandwiched in between. The surface of the photoconductor 1Y after transferring the toner image is cleaned by the photoconductor cleaner 5Y, is coated with a lubricant by a lubricant applicator 6Y, and is ready for a next electrostatic latent image formation. The waste toner removed from the photoconductor 1Y is discharged to and is collected in a waste toner bottle 48 by a waste toner conveyance screw via a conveyance path, both not shown.

As to the other image forming units 10M, 10C, and 10K, the image forming process as described above as to the image forming unit 10Y is performed in synchronous with the move of the intermediate transfer belt 21. On the other hand, the transfer sheet P fed out from the paper tray 41 is sent out by the registration roller pair 47 at a predetermined timing, and is conveyed to a secondary transfer position. Alternatively, the transfer sheet P fed out from a manual tray 50 disposed on a side of the image forming section 100 is fed into a manual sheet feed path 52 by a sheet feed roller 51, is sent out by a registration roller pair 47 at a predetermined timing, and is conveyed to the secondary transfer device 27. Then, the transfer sheet P on which a full-color image is transferred en bloc is conveyed by the conveyance belt 33 to the fixing device 30 where the toner image is fixed onto the transfer sheet P, and the transfer sheet P is discharged by a sheet ejection roller pair 53, and is ejected to a sheet ejection tray 54. Alternatively, the transfer sheet P, on which the toner image is transferred, is switched over by a switching claw, and is conveyed by the sheet reversing device 34 again to the secondary transfer device 27. Then, a toner image is recorded on a backside thereof, and the transfer sheet P is discharged on the sheet ejection tray 54 by the sheet ejection roller pair 53. On the other hand, the intermediate transfer belt 21 after the toner image transfer is subjected to the residual toner removal by the belt cleaner 29, and is ready for the next image forming operation by the image forming unit 10. The waste toner removed from the intermediate transfer belt 21 is discharged to and is collected in the waste toner bottle 48 via the waste toner conveyance screw and the conveyance path, both not shown.

The above image forming operation represents various processes performed in four-color superimposed full-color mode. When the monochrome mode is selected on the control panel, the support rollers 23, 24, and 25 other than the drive roller 22 are moved, so that the photoconductors 1Y, 1M, and 1C are separated from the intermediate transfer belt 21 and formation of K-toner image alone can be formed on the intermediate transfer belt 21.

Figure 2:
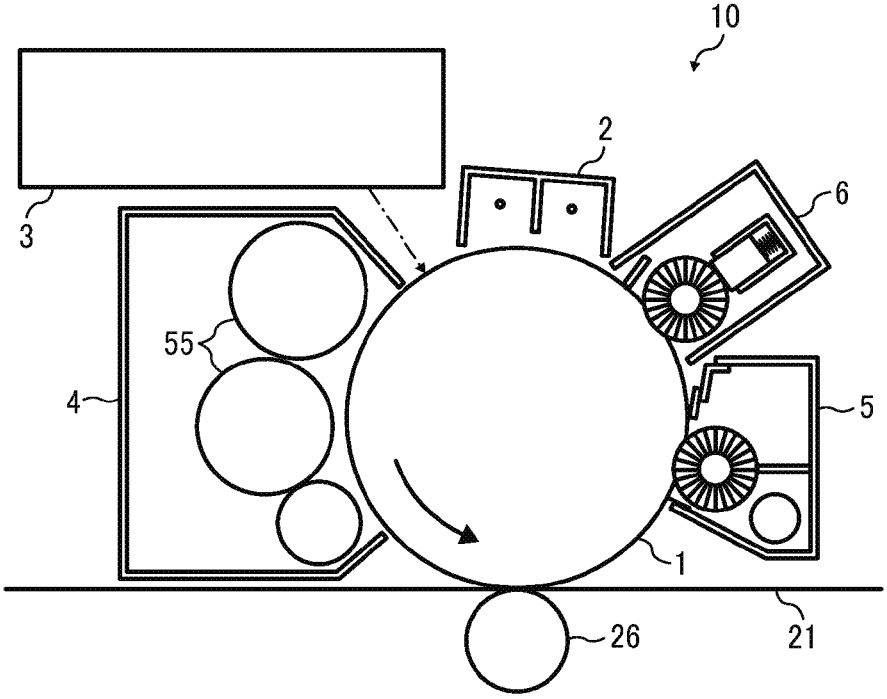
FIG. 2 is an enlarged partial view illustrating one of the image forming units and peripheral parts therearound shown in FIG. 1.

FIG. 2 is an enlarged partial view illustrating one of the image forming units and peripheral part thereof. Each image forming unit handles different color of toner but is configured identical to each other, so that the suffixes are appropriately omitted in the following description. As illustrated in FIG. 2, each image forming unit 10 according to the present embodiment includes a photoconductor 1 (which may be referred to as an image bearer), and a corona charger 2, a developing device 4, a photoconductor cleaner 5, and a lubricant applicator 6 that are disposed around the photoconductor 1. The thus-formed image forming unit 10 is disposed as a process cartridge detachably attachable to the printer body. In addition, in the image forming unit 10 according to the present embodiment, the photoconductor cleaner 5 and the lubricant applicator 6 may be integrally formed as illustrated in FIG. 1 with numerals 5Y, 5M, 5C, and 5K. The image forming unit 10 may be removed from the printer body and each of the photoconductor 1, the corona charger 2, the developing device 4, the photoconductor cleaner 5, and the lubricant applicator 6 may be formed to be removable from the image forming unit 10 and replaced with a new one, respectively.

Next, controlling of the photoconductor when driving is suspended will be described. The control process as described in the present embodiment can be performed by a controller 3 such as a microprocessor that the image forming section of the image forming apparatus includes.

As described above, after suspension of the image forming operation, corona products such as ozone, nitrogen oxide, nitric acid, and the like, adhered to and accumulated on the corona charger 2 adhere to the surface of the photoconductor 1 disposed immediately below the corona charger 2 in the suspended state after the end of printing. Then, due to water absorbability, moisture in the air condenses and the surface of the photoconductor 1 becomes low resistant. In this case, when the latent image is formed on the surface of the photoconductor 1, charged potential flows, thereby generating an abnormal image that is blurred or in which white spots appear. As a result, electrostatic capacity increases, and the potential of the photoconductor where the electrostatic capacity has increased, decreases.

Further, when the corona products penetrate to the surface layer of the photoconductor 1 immediately below the corona charger 2, the surface potential of the subject part of the photoconductor increases, so that the surface potential of the subject part of the photoconductor decreases, causing to increase density of the subject part in the formed image, and the black band to appear.

Accordingly, to prevent adhesion of the corona products to the same area on the surface of the photoconductor 1, the photoconductor 1 is caused to be driven intermittently at a predetermined interval determined by readings obtained by the sensor 55 detecting temperature and humidity, disposed in the image forming section 100 of the image forming apparatus.

Figure 4:
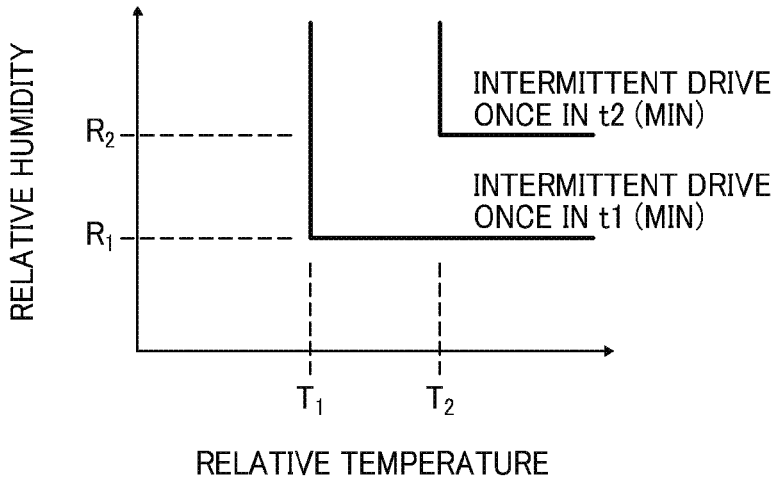
FIG. 4 is a graph representing a drive interval of a photoconductor according to a first embodiment.

FIG. 4 is a graph representing a drive interval of a photoconductor according to the present embodiment. When a relative temperature is T1 (degrees C.) or greater and a relative humidity is R1 (%) or greater, an intermittent drive is performed once in t1 (min). When the relative temperature is T2 (degrees C.) or greater and a relative humidity is R2 (%) or greater, an intermittent drive is performed once in t2 (min). The interval time of the intermittent drive satisfies a relation t1>t2. As the temperature and the humidity are high, the interval of the intermittent drive is shortened.

Three or more thresholds may be available. In addition, in the above context, the threshold is determined based on the relative temperature and the relative humidity, but can be determined based on the absolute humidity. In addition, a rotational amount of the photoconductor 1 in the intermittent drive is preferably from 90 degrees to 270 degrees. When the rotational amount is smaller than 90 degrees, sufficient effects are not obtained. When the rotational amount is more than 270 degrees, other members that rotate while contacting the photoconductor 1 do not rotate and the photoconductor alone rotates. In such a case, an adverse effect such that the blade member disposed inside the photoconductor cleaner 5 turns inside out may be caused.

In a state of suspended rotation of the photoconductor 1, the photoconductor 1 is caused to rotate a predetermined amount at a predetermined interval. A determination on whether or not the rotation operation of the photoconductor 1 is performed is based on the detection result of the sensor 55 to detect the temperature and humidity disposed inside the image forming section 100 of the image forming apparatus. With this structure, even when the printing operation is performed after a long standby period has passed since the end of the previous printing operation, an abnormal image is prevented from occurring.

Second Embodiment

Next, controlling of the photoconductor when driving is suspended according to a second embodiment will be described.

After suspension of the image forming operation, corona products such as ozone, nitrogen oxide, nitric acid, and the like, adhered and accumulated on the corona charger 2 adhere to the surface of the photoconductor 1 disposed immediately below the corona charger 2 in the suspended state after the end of printing. The adhered corona products have water-absorbing effects and the moisture in the air combines, so that the surface of the photoconductor 1 has a low resistance. In this case, when the latent image is formed on the surface of the photoconductor 1, charged potential flows, thereby causing to generate an abnormal image or image blur in which white spots appear. As a result, electrostatic capacity increases, and the potential of the photoconductor where the electrostatic capacity has increased, decreases. Further, when the corona products penetrate to the surface layer of the photoconductor 1 immediately below the corona charger 2, the surface potential of the subject part of the photoconductor increases, so that the surface potential of the subject part of the photoconductor decreases, causing to increase density of the subject part in the formed image, and the black band to appear.

The above phenomenon tends to occur when the lubricant applicator 6 applies more lubricant to the photoconductor 1. Because the lubricant accumulates more as use history of the photoconductor 1 is longer, the abnormal image tends to occur. Accordingly, to prevent adhesion of the corona products to the same area on the surface of the photoconductor 1, the photoconductor 1 is caused to be driven intermittently at a predetermined interval. The interval to drive the photoconductor 1 depends on the result of use history of the photoconductor 1.

Figure 5:
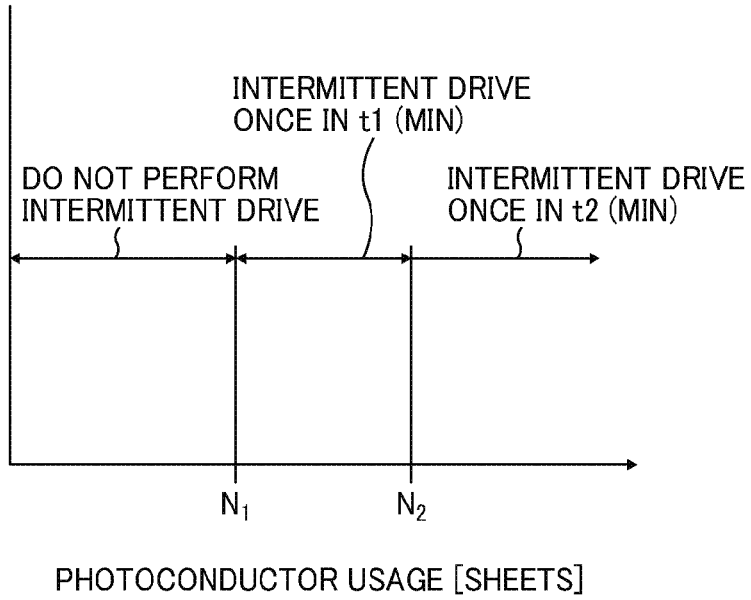
FIG. 5 is a graph representing a drive interval of the photoconductor according to a second embodiment.

FIG. 5 is a graph representing a drive interval of a photoconductor 1 according to the second embodiment.

When the use history of the photoconductor 1 is N1 (sheets) or greater, an intermittent drive is performed once in t1 (min). When the use history is N2 (sheets) or greater, an intermittent drive is performed once in t2 (min). The interval time of the intermittent drive satisfies a relation t1>t2. As the use history of the photoconductor 1 is longer, the interval of the intermittent drive is set to shorter.

As with the first embodiment, three or more thresholds can be applied and the rotational amount of the photoconductor 1 in the intermittent drive is preferably from 90 degrees to 270 degrees.

As described above, in the state of suspended rotation of the photoconductor 1, the photoconductor 1 is caused to rotate only a predetermined amount at a predetermined interval. The determination whether or not the rotation operation is performed is made based on the use history of the photoconductor 1, so that, even when the printing operation is performed after a long standby period has passed since the end of the previous printing operation, an abnormal image is prevented from occurring and a quality image can be obtained in the second embodiment.

It can be set that a predetermined amount of rotation operation is performed when the use period of the photoconductor 1 is longer than the predetermined period. The rotation operation in the above case can be set such that the interval of the operation is made shorter as the use period of the photoconductor 1 is longer.

Third Embodiment

Hereinafter, a third embodiment of the present invention will be described.

The third embodiment includes a following aspect in preventing an excessive accumulation of the corona products on the photoconductor or the image bearer 1. Specifically:

(1) The image bearer 1 is rotated slightly during standby time of the image forming apparatus;

(2) The slight rotation of the image bearer 1 is performed in high temperature and high humidity environment; and (3) The slight rotation of the image bearer 1 is performed based on a control table including and based on a number of prints from when the surface of the image bearer 1 has been refreshed in the latest occasion and the standby time period since the end of the previous printing operation.

As described above, the generation amount of the corona products tends to decrease gradually from immediately after the printing operation has been finished, and tends to saturate in a predetermined time later. However, the corona products accumulation on the image bearer 1 increases more as the standby time becomes longer, so that the abnormal image tends to occur and the level of occurrence of the abnormal image gets worse (see FIG. 6).

Specifically, the corona products on the image bearer 1 can be removed from the surface of the image bearer 1 by refreshing operation, but after the refreshing operation and during the printing operation, the corona products gradually accumulate on the surface of the image bearer 1. As a result, when the number of prints increases further after the refreshment of the image bearer 1, the corona products on the surface of the image bearer 1 tends to increase and the abnormal image occurs when the corona products exceeds a certain amount.

Figure 6:
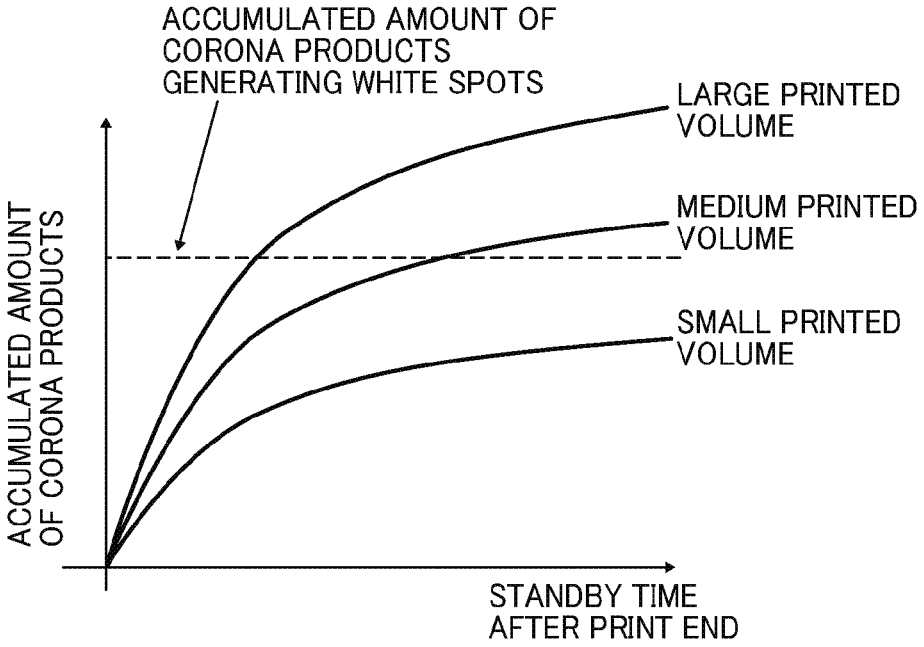
FIG. 6 is a graph representing a relation between a standby time and accumulation of corona products according to a third embodiment.
Figure 7A:
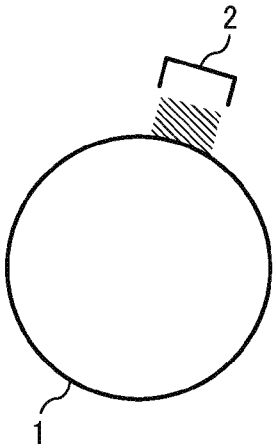
FIGS. 7A and 7B schematically illustrate accumulation of the corona products on the image bearer according to a third embodiment.
Figure 7B:
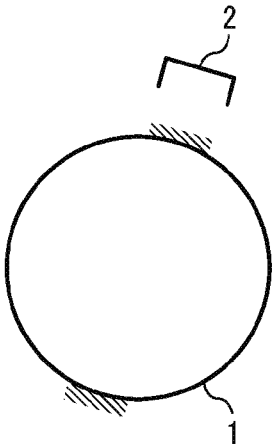

FIG. 6 illustrates a relation between a standby time period, in which the printing operation is suspended after the end of printing, and the corona products accumulation on the surface of the image bearer 1. FIGS. 7A and 7B illustrate difference in the accumulation of the corona products accumulated on the image bearer 1 between cases when the slight rotation of the image bearer 1 exists and when it does not exist. FIG. 7A illustrates a state in which the corona products accumulate immediately below the charger 2 without a slight rotation. FIG. 7B illustrates a state in which the accumulated corona products at a place decreases because the corona products accumulate at plural places on the image bearer 1 due to a slight rotation.

As described above, after the end of the printing operation, that is, in the printing suspension period, the corona products accumulate on the image bearer 1. The generation amount of the corona products is large immediately after the printing suspension, and tends to decrease as the standby time increases. The corona products in the printing suspension period accumulate immediately below the charger when the image bearer 1 is not slightly rotated, and if the accumulation exceeds a certain amount, the abnormal image such as white spots occurs. When the image bearer 1 is rotated slightly, the total amount of the corona products generated from the charger does not change, but because the total amount of the corona products accumulated at a place on the image bearer 1 decreases, the abnormal image does not tend to occur due to the corona products. When the slight rotation of the image bearer 1 is performed more frequently, the total amount of the corona products accumulated at a place can be reduced more.

The rotational amount of the slight rotation of the image bearer 1 is preferably from 60 degrees to 90 degrees in one slight rotation, and the interval of the slight rotation is preferably set as shown in Table 1, so that the abnormal image due to the corona products can be prevented from occurring. The slight rotation control of the image bearer 1 is thus performed, and the abnormal image due to the corona products can be prevented from occurring. However, that the slight rotation is performed too frequently causes an adverse effect of a rise of the load of the photoconductor cleaner 5 (the image bearer cleaner 5), and the like, so that the slight rotation is preferably performed when the standby time continues from 5 minutes to 60 minutes.

In addition, to prevent the rise of the load of the image bearer cleaner 5 during the slight rotation of the image bearer 1, the lubricant applicator is preferably driven simultaneously. Further, by driving a developer bearer simultaneously with the slight rotation of the image bearer 1, the corona products adhered on the image bearer 1 during the slight rotation can be removed, the developer bearer is preferably driven simultaneously when the corona products are generated greatly.

Table 1 below illustrates an exemplary control method of the corona products.

TABLE 1

| | | 0 to 5 min. | 5 to 15 min. | 15 to 30 min. | 30 to 60 min. |
|---|---|---|---|---|---|
| Number of prints after photoconductor refreshment [kP] | 0 to 5 | 0 min. | 5 min. | 10 min. | 30 min. |
| | 5 to 10 | 0 min. | 3 min. | 5 min. | 15 min. |
| | 10 to 20 | 0 min. | 2 min. | 3 min. | 10 min. |
| | 20 to 50 | 0 min. | 1 min. | 2 min. | 5 min. |
| | 50 or more | 0 min. | 0.5 min. | 1 min. | 2 min. |

One exemplary control table shows that a vertical column includes corona products accumulation on the surface of the image bearer 1 (controlled by the number of prints) and a horizontal row includes standby time periods from the end of the previous printing to the start of next printing, and the cross-point shows the rotation interval of the slight rotation of the image bearer 1. The interval of the slight rotation is preferably shortened immediately after the end of the printing, and the interval of the slight rotation is preferably lengthened as the standby time increases. In addition, the interval of the slight rotation control is preferably shortened when the number of prints are large from when the corona products removal mode was performed until a next corona products removal operation. Further, the time interval of the slight rotation control is preferably changed based on the standby time of the image forming apparatus. The slight rotation control to control the slight rotation can be enabled by the controller 300 such as a microprocessor that the image forming apparatus 100 includes.

According to the present embodiment, even a heavy user who prints mass printing volume can prevent abnormal images from occurring automatically due to the corona products accumulation, before the user recognizes the abnormal image caused by the corona products. Specifically, because the image with white spots due to the corona products aggravates as the printing volume of the user increases, the accumulation of the corona products can be prevented by performing the slight rotation of the image bearer 1 based on the number of prints since the surface of the image bearer 1 has been refreshed lastly and the standby time since the end of the print suspension.

The present invention is not limited only to the aforementioned embodiments, but various modifications can be applied thereto by an engineer who belongs to the present technical field, within the scope of the present invention.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

an image bearer;

a charger to charge a surface of the image bearer;

a microprocessor to control rotation of the image bearer; and wherein, in a state of suspended rotation of the image bearer, the microprocessor controls the image bearer to rotate a predetermined amount at a predetermined interval, and determines whether a rotation operation of the image bearer is to be performed, based on a use history of the image bearer;

wherein the rotation operation of the predetermined amount of the image bearer is performed when the use history of the image bearer is equal to or exceeds a predetermined threshold amount;

wherein the microprocessor initiates the rotation operation of the predetermined amount of the image bearer at a shorter interval the longer the use history of the image bearer.

2. The image forming apparatus as claimed in claim 1, wherein the predetermined amount of rotation of the image bearer ranges from 90 degrees to 270 degrees.

3. An image forming apparatus comprising:

an image bearer;

a corona charger to charge a surface of the image bearer by corona charging;

an image bearer cleaner to remove a residual toner remaining on the surface of the image bearer;

a lubricant applicator to coat a lubricant on the image bearer;

a mode to remove the corona products accumulated on the surface of the image bearer; and a microprocessor to rotate the image bearer a predetermined amount in a standby time of the image forming apparatus, wherein the microprocessor changes a time to perform a rotation of the image bearer based on a number of prints from when a previous corona products removal mode has been performed to when a next corona products removal mode is performed;

wherein the microprocessor shortens an interval of the rotation of the image bearer immediately after an end of printing and lengthens the interval the longer the standby time.

4. The image forming apparatus as claimed in claim 3, wherein the microprocessor shortens an interval of the rotation of the image bearer the larger the number of prints from when the previous corona products removal mode has been performed to when the next corona products removal mode is performed.

5. The image forming apparatus as claimed in claim 3, wherein the microprocessor changes an interval of the rotation of the image bearer in accordance with the standby time of the image forming apparatus.

6. The image forming apparatus as claimed in claim 3, wherein the lubricant applicator is driven simultaneously with the rotation of the image bearer.

7. The image forming apparatus as claimed in claim 3, wherein the developing device includes a developer bearer to bear toner, and the developer bearer is driven simultaneously with the rotation of the image bearer.

* * * * *